US005627127A

United States Patent [19]

Hiroi et al.

[11] Patent Number: 5,627,127

[45] **Date of Patent: *May 6, 1997**

[54] THERMAL TRANSFER SHEET

[75] Inventors: Junichi Hiroi; Haruo Takeuchi; Naoto Satake, all of Tokyo, Japan

[73] Assignee: Dai Nippon Printing Co., Ltd., Japan

[ * ] Notice: The term of this patent shall not extend beyond the expiration date of Pat. No. 5,418,209.

[21] Appl. No.: 385,977

[22] Filed: Feb. 9, 1995

Related U.S. Application Data

[62] Division of Ser. No. 80,834, Jun. 24, 1993, Pat. No. 5,418, 209.

[30] Foreign Application Priority Data

| | | | |
|---|---|---|---|
| Jun. 29, 1992 | [JP] | Japan | 4-170687 |
| Jul. 31, 1992 | [JP] | Japan | 4-214738 |
| Dec. 28, 1992 | [JP] | Japan | 4-358502 |

[51] Int. Cl.[6] ..... B41M 5/035; B41M 5/38

[52] U.S. Cl. ..... 503/227; 428/195; 428/207; 428/323; 428/423.1; 428/488.4; 428/500; 428/704; 428/913; 428/914

[58] Field of Search ..... 428/488.4, 704, 428/913, 914, 195, 484, 488.1, 207, 323, 423.1; 503/227

[56] References Cited

U.S. PATENT DOCUMENTS

| | | | |
|---|---|---|---|
| 4,737,485 | 4/1988 | Henzel et al. | 503/227 |
| 4,961,997 | 10/1990 | Asano et al. | 428/423.1 |
| 5,418,209 | 5/1995 | Hiroi et al. | 503/227 |

FOREIGN PATENT DOCUMENTS

| | | | |
|---|---|---|---|
| 0153880 | 9/1985 | European Pat. Off. | 503/227 |
| 0194106 | 9/1986 | European Pat. Off. | 503/227 |
| 0234043 | 9/1987 | European Pat. Off. | 503/227 |
| 0314348 | 5/1989 | European Pat. Off. | 503/227 |
| 2-231180 | 9/1990 | Japan | 503/227 |

OTHER PUBLICATIONS

Patent Abstracts of Japan, vol. 10, No. 163 (M–487) [2219] Jun. 11, 1986.

*Primary Examiner*—B. Hamilton Hess
*Attorney, Agent, or Firm*—Parkhurst, Wendel & Burr, L.L.P.

[57] ABSTRACT

A thermal transfer sheet including a substrate film, a recording agent layer formed on one surface of the substrate film, and a back surface layer formed on the other surface of the substrate film, the back surface layer containing at least one lubricant having a heat decomposition temperature of 200° C. or above including a thermal transfer sheet comprising a substrate sheet, a thermally transferable colorant layer formed on one surface of the substrate sheet and a back surface layer formed on the other surface of the substrate sheet, said back surface layer containing a phosphoric ester surfactant, an alkaline substance and a binder. A thermal transfer sheet comprising a substrate sheet, a thermally transferable colorant layer formed on one surface of the substrate sheet and a back surface layer formed on the other surface of the substrate sheet, the back surface layer comprising a resin binder and particles having a Mohs hardness of less than 3.

14 Claims, 1 Drawing Sheet

THERMAL TRANSFER SHEET

This is a division of application Ser. No. 08/080,834 filed Jun. 24, 1993, now U.S. Pat. No. 5,418,209.

BACKGROUND OF THE INVENTION

The present invention relates to a thermal transfer sheet, and more particularly to a thermal transfer sheet which is excellent particularly in lubricity and heat resistance and can contribute to an improvement in the durability of a thermal head.

When an output of computers or word processors is printed by a thermal transfer system, use has hitherto been made of a thermal transfer sheet comprising a substrate film and, provided on one surface thereof, a hot-melt ink layer. Further, there is a sublimation thermal transfer system which is excellent in continuous tone and can provide a full color image comparable to a color photograph.

The thermal transfer sheet used in the hot-melt transfer system or sublimation thermal transfer system comprises a substrate film and, provided thereon, a recording agent layer comprising a hot-melt ink or a recording agent layer containing a sublimation dye.

In the above-described thermal transfer sheet, printing and formation of an image are effected by putting a recording agent and a material, on which an image is to be transferred, on top of each other and heating the assembly from the back surface of the substrate film by means of a thermal head.

However, when materials having a poor heat resistance, such as plastic films, are used as the substrate film, the substrate film sticks on the thermal head during printing, which is detrimental to peelability of the thermal transfer sheet from the thermal head and a slip property or gives rise to breaking of the substrate film, etc.

For this reason, a back surface layer having a heat resistance and a slip property is formed on the back surface of the substrate film. In order to improve the heat resistance of the back surface layer, for example, it is possible to form the back surface layer by using a thermosetting resin, a thermoplastic resin having a high-softening point, etc., or to incorporate inorganic particles or crosslinked resin particles having high heat resistance and lubricity into the back surface layer. In order to improve the slip property of the back surface layer, a proposal has been made on the addition of lubricants, such as silicone oil, low-melting wax and surfactants.

Although surfactants, such as phosphoric ester surfactants, have been used as a lubricant having a high lubricity, they had a problem that, when use is made of surfactants having a low heat decomposition temperature, they are decomposed by heat applied by the thermal head to produce a decomposition product which unfavorably deteriorates or corrodes the surface protective layer of the thermal head or deposits as refuse on the thermal head.

It is also known that a slip layer is formed by using a silicone oil or a silicone wax. Since, however, the silicone oil or wax has a low film strength, it is unfavorably scraped by the thermal head being travelled and gathers as refuse on the thermal head, so that good print cannot be provided.

Under the above-described circumstances, the present invention has been made, and an object of the present invention is to provide a thermal transfer sheet provided with a back surface layer capable of reducing the abrasion of the thermal head.

It is known that a back surface layer containing a phosphoric ester surfactant having an excellent lubricity is provided on the contact surface of the thermal head for the purpose of preventing the inhibition of travel of the thermal head and occurrence of breaking or wrinkle of the thermal transfer sheet attributable to sticking of the thermal transfer sheet to the thermal head. Since, however, the phosphoric ester surfactant has 1 to 2 equivalents of an acid radical, it unfavorably corrodes the thermal head. Further, when the quantity of heat from the thermal head becomes large, the phosphoric ester is decomposed, which further lowers the pH value, so that the corrosion abrasion of the thermal head becomes severe. It is a matter of course that the use of a phosphoric ester surfactant converted to a salt type though neutralization is known in the art. Since, however, such a surfactant has a poor lubricity, the stickiness of the thermal transfer sheet to the thermal head cannot be prevented. Accordingly, the second object of the present invention is to provide a thermal transfer sheet provided with a good back surface layer which is excellent in heat resistance, film property, slip property, etc., can provide good travelling of the thermal head and gives rise to neither gathering of refuse on the thermal head nor abrasion of the thermal head.

In the above-described thermal transfer sheet, since a thin polyester film has hitherto been used as the substrate film, the thermal transfer sheet had a problem that, during printing with a thermal head, the thermal head is fused to the back surface of the thermal transfer sheet to give rise to wrinkle on the thermal transfer sheet or breaking of the thermal transfer sheet. In order to solve these problems, a layer having a heat resistance and a lubricity has been formed on the back surface of the substrate sheet. For example, a proposal has been made on the incorporation of lubricants having an excellent lubricity, such as silicone lubricants, surfactant lubricants, various types of wax and fatty acids, into a heat-resistant layer (see, for example, Japanese Patent Application No. 137977/1990). This method, however, has a problem of contamination of the thermal head with the lubricant bled out on the back surface layer and a problem of poor workability.

Examples of other methods known in the art include a method wherein particles or the like are added to the back surface layer to render the surface of the back surface layer uneven, thereby reducing the area of contact of the back surface layer with the thermal head to impart the lubricity to the back surface layer (see, for example, Japanese Patent Application No. 145390/1990) and a method wherein use is made of a combination of this method with the above-described methods (see, for example, Japanese Patent Application No. 259889/1977). In these methods, however, the travelling of the energized head during energization heating is poor, which often has an adverse effect on the printed image depending upon the configuration of the uneven portions or the properties of the particles used or gives rise to abrasion of the thermal head.

Accordingly, the third object of the present invention is to provide a thermal transfer sheet which is excellent in both the heat resistance and lubricity, can provide good travelling of the thermal head and form a good image and gives rise to no abrasion of the thermal head.

SUMMARY OF THE INVENTION

In order to attain the above-described object, according to one aspect of the present invention, there is provided a thermal transfer sheet comprising a substrate film, a recording agent layer formed on one surface of said substrate film, and a back surface layer formed on the other surface of said substrate film, said back surface layer containing at least one lubricant having a heat decomposition temperature of 200° C. or above.

When printing or formation of an image is effected by putting the recording agent layer and a material, on which an image is to be transferred, on top of each other and heating the assembly from the back surface layer of the substrate sheet by means of a thermal head, since the back surface layer contains at least one lubricant having a heat decomposition temperature of 200° C. or above, the heat decomposition product produced by the heat applied by the thermal head is reduced according to the proportion of the lubricant having the above-described heat decomposition temperature relative to the whole lubricant, so that the abrasion of the thermal head is also reduced.

The above-described second object can be attained by the following invention. Specifically, according to another aspect of the present invention, there is provided a thermal transfer sheet comprising a substrate sheet, a thermally transferable colorant layer formed on one surface of the substrate sheet and a back surface layer formed on the other surface of the substrate sheet, said back surface layer containing a phosphoric ester surfactant, an alkaline substance and a binder.

When a phosphoric ester surfactant and an alkaline substance are added to the back surface layer of the thermal transfer sheet, even though the phosphoric ester surfactant is decomposed by heat applied by the thermal head to produce an acid radical or activated by heat to have a strongly acidic nature, since the acid radical is neutralized with the alkaline substance coexisting in the system, there occurs neither corrosion nor abrasion of the thermal head attributable to the occurrence of an acid radical.

Further, according to a preferred embodiment, the adoption of a particular binder can provide a thermal transfer sheet having good heat resistance and back surface layer which is excellent in the travelling of the thermal head and gives rise to neither gathering of refuse on the thermal head nor abrasion of the thermal head.

The above-described third object can be attained by the following invention. Specifically, according to a further aspect of the present invention, there is provided a thermal transfer sheet comprising a substrate sheet, a thermally transferable colorant layer formed on one surface of the substrate sheet and a back surface layer formed on the other surface of the substrate sheet, said back surface layer comprising a resin binder and particles having a Mohs hardness of less than 3.

The presence of particles having a Mohs hardness of less than 3 in the back surface layer can provide a thermal transfer sheet which is excellent in both heat resistance and lubricity, can provide good travelling of the thermal head and form a good image and gives rise to no abrasion of the thermal head.

BEST MODE FOR CARRYING OUT THE INVENTION

Figure 1:
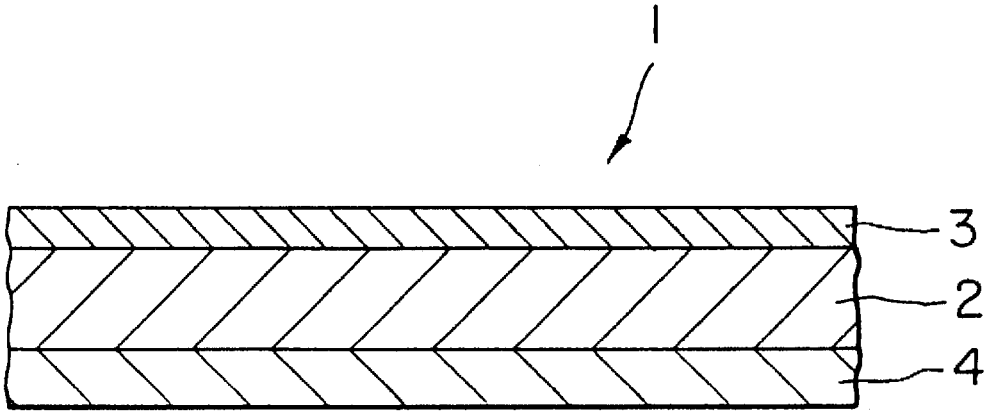
FIG. 1 is a cross-sectional view of the thermal transfer sheet according to one embodiment of the present invention.

Embodiments of the present invention will now be described with reference to the accompanying drawing.

FIG. 1 is a schematic cross-sectional view of one embodiment of the thermal transfer sheet of the present invention.

In FIG. 1, the thermal transfer sheet 1 comprises a substrate film 2, a back surface layer 3 formed on one surface of the substrate film 2 and a recording agent layer 4 formed on the other surface of the substrate film 2. A thermal head (not shown) is brought into contact with the back surface layer 3.

In the present invention, there is no particular limitation on the substrate film 2, and use may be of various substrate films used in the conventional thermal transfer sheet.

Preferred examples of the substrate film 2 include films of plastics, such as polyesters, polypropylene, polyphenylene sulfide (PPS), polyethylene naphthalate (PEN), 1,4-polycyclohexylene dimethylene terephthalate (PCT), cellophane, polycarbonate, cellulose acetate, polyethylene, polyvinyl chloride, polystyrene, nylon, polyimide, polyvinylidene chloride, polyvinyl alcohol, fluororesin, chlorinated rubber and ionomer, paper, such as capacitor paper and paraffin paper, and nonwoven fabrics. Further, it is also possible to use a laminate comprising any combination of the above-described substrate films.

Although the thickness of the substrate film 2 may be properly determined by taking necessary strength and heat conductivity into consideration, it is generally in the range of from about 0.5 to 50 μm, preferably in the range of from about 3 to 10 μm.

The back surface layer in the thermal transfer sheet according to the first aspect of the present invention will now be described.

The back surface layer 3 serves to impart heat resistance and slip property to the back surface (the surface with which the thermal head is brought into contact) of the substrate film, and comprises a binder resin, a lubricant and other necessary additives. At least one lubricant having a heat decomposition temperature of 200° C. or above is contained as the lubricant.

Examples of the lubricant used in the back surface layer 3 include wax, such as polyethylene wax and paraffin wax, higher aliphatic alcohols, organopolysiloxane, anionic surfactants, cationic surfactants, amphoteric surfactants, nonionic surfactants, fluorosurfactants, organic carboxylic acids and their derivatives.

Among them, examples of lubricants having a heat decomposition temperature of 200° C. or above include alkali metal salts or amides of carboxylic acids and sulfonic acids (for example, sodium sulfonate), alkali metal salts of phosphoric esters and sulfuric esters (for example, a sodium salt of a phosphoric ester), esters or amides of higher fatty acids, wax, paraffin and organopolysiloxanes.

The amount of the lubricant contained in the back surface layer 3 is in the range of from 5 to 50% by weight, preferably in the range of from 10 to 30% by weight. The proportion of the lubricant having a heat decomposition temperature of 200° C. or above relative to the whole lubricant is in the range of from 1 to 100% by weight, preferably in the range of from 50 to 100% by weight.

As described above, since the back surface layer 3 contains at least one lubricant having a heat decomposition temperature of 200° C. or above, there occurs no or little, if any, heat decomposition of the lubricant by heat applied by means of the thermal head. Therefore, the deterioration (corrosion) of the surface protective film of the thermal head attributable to the heat decomposition product produced by the heat decomposition of the lubricant, which is a problem of the conventional thermal transfer sheet, can be effectively prevented, which favorably results in the reduction of the abrasion of the thermal head.

Examples of the binder resin used in the back surface layer 3 include cellulosic resins, such as ethyl cellulose, hydroxyethyl cellulose, hydroxypropyl cellulose, methyl cellulose, cellulose acetate, cellulose acetobutyrate and nitrocellulose, vinyl resins, such as polyvinyl alcohol, polyvinyl acetate, polyvinyl butyral, polyvinyl acetal, polyvinyl pyrrolidone, acrylic resins, polyacrylamide and acrylonitrile-styrene copolymers, polyester resins, polyurethane resin, and silicone-modified or fluorine-modified urethane. In this connection, it is preferred that a binder resin having a reactive group, for example, a hydroxyl group, is used in combination with a crosslinking agent, such as polyisocyanate, to form a cross inked resin layer.

The back surface layer in the thermal transfer sheet according to the second aspect of the present invention will now be described..

The back surface layer formed on one surface of the above-described substrate sheet is characterized by containing a phosphoric ester surfactant and an alkaline substance. Examples of the phosphoric ester surfactant include nonionic or anionic phosphoric ester surfactants, for example, (1) long-chain alkylphosphoric esters, for example, mono and/or diesters of saturated or unsaturated higher alcohols having usually 6 to 20 carbon atoms, preferably 12 to 18 carbon atoms, for example, cetyl alcohol, stearyl alcohol or oleyl alcohol, with phosphoric acid;

(2) phosphoric esters, such as polyoxyalkylene alkyl ethers or polyoxyalkylene alkylaryl ethers;

(3) phosphoric mono or diester salts of alkylene oxide adducts of the above-described saturated or unsaturated alcohols (number of moles of addition: usually 1 to 8) or alkylene oxide adducts of alkyl phenols or alkylnaphthols having at least one, preferably 1 to 2 alkyl groups having 8 to 12 carbon atoms (such as nonyl phenol, dodecyl phenol and diphenyl phenol) (number of moles of addition: usually 1 to 8).

Examples of the alkaline substance used in combination with the above-described phosphoric ester surfactants include oxides or hydroxides of alkali metals or alkaline earth metals and/or organic amines.

Preferred examples of the oxide or hydroxide of alkali metal or alkaline earth metal include magnesium hydroxide, magnesium oxide, hydrotalcite, aluminum hydroxide, aluminum silicate, magnesium silicate, magnesium carbonate and alumina hydroxide/magnesium aluminum glycinate. They particularly preferably have a Mohs hardness of less than 3. Preferred examples of the organic amine include mono-, di- or trimethylamine, mono-, di- or triethylamine, mono-, di- or tripropylamine, mono-, di- or tributylamine, mono-, di- or tripentylamine, trihexylamine, trioctylamine, monodecylamine, mono- or didecylamine, monotridecylamine, monotetradecylamine, monopentadecylamine, monohexadecylamine, monoheptadecylamine, monooctadecylamine, monoeicosylamine, monodocosylamine, mono-, di- or triethanolamine, mono- or dipropanolamine, monoisopropanolamine, N-methyl-nonylamine, N-methyldecylamine and N-ethyl-palmitylamine. The organic amine is particularly preferably nonvolatile at room temperature and has a boiling point of 200° C. or above.

These amines stably exist in the back surface layer, and, when heat is applied to the back surface layer by the thermal head, they become fluid or bleed out on the surface of the back surface layer to easily neutralize an acid radical produced in the phosphoric ester surfactant or a heat decomposition product thereof, thereby preventing the corrosion of the thermal head and, at the same time, developing an excellent lubricity together with the phosphoric ester surfactant.

With respect to the amount of use of the above-described phosphoric ester surfactant and alkaline substance, it is suitable that the amount of the alkaline substance is in the range of from 0.1 to 10 mol based on one mole of the phosphoric ester surfactant. When the amount of the alkaline substance is excessively small, the object of the present invention cannot be attained, while when it is excessively large, no further improvement in the effect can be attained. The oxides or hydroxides of alkali metals or alkaline earth metals and the organic amines may be used alone or in combination thereof.

The above-described phosphoric ester surfactant and alkaline substance are essential components of the back surface layer of the thermal transfer sheet according to the present invention. In some cases, however, when the back surface layer consists of the above-described components alone, the strength of the film as the back surface layer is unsatisfactory. Therefore, it is preferred to use as a film forming agent a resin binder in combination with the above-described components.

Although the resin binder may be a thermosetting resin, an ionizing radiation curing resin or the like so far as it has a capability of forming a film, the thermoplastic resin or a crosslinked product thereof is preferred. Preferred examples of the thermoplastic resin include polyester resins, polyacrylic ester resins, polyvinyl acetate resins, styrene-acrylate resins, polyurethane resins, polyolefin resins, polystyrene resins, polyvinyl chloride resins, polyether resins, polyamide resins, polycarbonate resins, polyetylene resins, polypropylene resins, polyacrylate resins, polyacrylamide resins, polyvinyl chloride resins, and polyvinyl acetal resins, such as polyvinyl butyral resins and polyvinyl acetoacetal resins, are particularly preferred. Among them, thermoplastic resins having a hydroxyl radial, particularly polyvinyl acetal resins, such as polyvinyl butyral resins and polyacetoacetal resins, are particularly preferred.

In a preferred embodiment of the present invention, it is preferred to use polyisocyanate as a crosslinking agent in combination with the above-described components for the purpose of imparting, to the back surface layer, good heat resistance and film properties and adhesion to the substrate material. These polyisocyanates may be any known polyisocyanate used in paints, adhesives, synthesis of polyurethane, etc. Examples of these polyisocyanate compounds include those commercially availiable under the trade names of Takenate (manufactured by Takeda Chemical Industries, Ltd.), Barnock (manufactured by Dainippon Ink and Chemicals, Inc.), Coronate (manufactured by Nippon Polyurethane Industry Co., Ltd.),, Duranate (manufactured by Asahi Chemical Industry Co., Ltd.), and Desmodur (manufactured by Bayer).

The amount of addition of the polyisocyanate is preferably in the range of from 5 to 200 parts by weight based on 100 parts by weight of the resin binder constituting the back surface layer. It is preferably in the range of from about 0.8 to 2.0 in terms of the NCO/OH ratio. When the polyisocyanate content is excessively low, the crosslinking density is so low that the heat resistance is unsatisfactory. On the other hand, it is excessively high, there occur problems including that it is impossible to regulate the shrinkage of the formed coating, the curing time is prolonged and the unreacted NCO remains in the back surface layer to react with moisture in the air.

In the present invention, in order to form a back surface layer from the above-described materials, it is also possible to incorporate heat release agents and lubricants, such as wax, higher fatty acid amides and other surfactants, antistatic agents, powders of organic materials, such as fluororesins, and particles of inorganic materials, such as silica, clay, talc and calcium carbonate for the purpose of improving the slip property of the back surface layer. Further, in order to improve the antistatic property of the thermal transfer sheet, it is also possible to add antistatic agents, such as surfactants, and conductive agents, such as carbon black.

The back surface layer is formed by dissolving or dispersing the above-described materials in a suitable solvent, such as acetone, methyl ethyl ketone, toluene or xylene, to prepare a coating solution, coating the coating solution by conventional coating means, such as a gravure coater, a roller coater or a wire bar, and drying the coating.

The coverage, that is, the thickness of the back surface layer is also important, and in the present invention, it is possible to form a back surface layer having a satisfactory performance in a thickness of 5.0 $g/m^2$ or less, preferably 0.1 to 1.0 $g/m^2$, on a solid basis. In the present invention, in many cases, since unreacted isocyanate group remains in the back surface layer as formed, it is preferred to effect a sufficient aging treatment after the formation of the layer. Such a treatment causes the back surface layer to have a pencil hardness of about H to 2H. It is also useful to form a primer layer comprising a polyurethane resin or the like prior to the formation of the above-described back surface layer.

The back surface layer in the thermal transfer sheet according to the third aspect of the present invention will now be described.

In the third aspect of the present invention, the back surface layer is formed on one surface of the above-described substrate sheet by using a resin binder and particles as main materials. The resin binder may be any resin having a certain degree of heat resistance and film forming property, and examples thereof include thermoplastic resins, such as polyester resins, polyacrylic ester resins, polyvinyl acetate resins, styrene-acrylate resins, polyurethane resins, polyolefin resins, polystyrene resins, polyvinyl chloride reins, polyether resins, polyamide resins, polycarbonate resins, polyethylene resins, polypropylene resins, polyacrylate, resins, polyacrylamide resins polyvinyl chloride resins, polyvinyl butyral resins and polyvinyl acetoacetal resins, and silicone-modified products of the above-described resins. They may be used alone or in the form of a mixture thereof. Among them, polyvinyl acetal resins, such as polyvinyl butyral resins and polyacetoacetal resins, and silicone-modified products thereof are particularly preferred. A particularly preferred resin is a resin having a reactive group capable of reacting with the isocyanate group, such as a hydroxyl group.

These resin binders may contain polyisocyanates, chelate curing agents, radiation polymerizable monomers, etc. so as to form a film having a crosslinked structure. When the film has a crosslinked structure, the heat resistance and strength of the film can be improved, so that it becomes possible to eliminate the problem of gathering of refuse on a thermal head during printing with the thermal head and a failure of printers attributable to the gathering of refuse.

Polyisocyanates are preferably used as the crosslinking agent. These polyisocyanates may be any known polyisocyanate used in paints, adhesives, synthesis of polyurethane, etc. Examples of these polyisocyanate compounds include those commercially available under the trade names of Takenate (manufactured by Takeda Chemical Industries, Ltd.), Barnock (manufactured by Dainippon Ink and Chemicals, Inc.), Coronate (manufactured by Nippon Polyurethane Industry Co., Ltd.), Duranate (manufactured by Asahi Chemical Industry Co., Ltd.), and Desmodur (manufactured by Bayer). The amount of use of the above-described polyisocyanates is in the range of from 50 to 300 parts by weight in terms of the effective component based on 100 parts by weight of the resin binder.

The particles used in the present intention have a Mohs hardness of less than 3.0, preferably 2.5 or less, and examples thereof include particles of inorganic materials, such as talc, kaolin, graphite, niter, gypsum and brucite, and particles of organic resins having a hardness corresponding to a Mohs hardness of less than 3.0, such as acrylic resins, teflon resins, silicone resins, lauroyl resins, phenolic resins and crosslinked polyacetal resins. When the above-described inorganic particles are natural inorganic particles, even though they contain impurity particles having a Mohs hardness of 3.0 or more, such inorganic particles can be used in the present invention without any problem so far as the content of the impurity particles is less than 5% by weight.

The Mohs hardness is measured with Mohs scale of hardness. The Mohs hardness has been proposed by F. Mohs. 10 minerals ranging from soft minerals to hard minerals are contained in a box with the order of hardness being designated from the softest to the hardness: 1°, 2°, . . . , 10°. Reference minerals used are as follows (numerals represent hardness).

1: talc, 2: gypsum, 3: calcite, 4: fluorite, 5: apatite, 6: orthoclase, 7: quartz, 8: topaz, 9: corundum, and 10: diamond.

When the surface of a mineral sample of which the hardness is to be determined is scratched with a reference mineral to give a scratch, a comparison of the hardness between the two minerals can be made based on the force resistant to the scratch (i.e. Whether or not a scratch occurs). For example, when the sample is scratched with calcite, if no scratch occurs in the mineral sample with a scratch occurring in the calcite, the hardness of the sample is larger than 3°. If the fluorite gives a scratch to the sample with no scratch occurring in the fluorite, the hardness of this sample is smaller than 4°. In this case, the hardness of the sample is designated 3 to 4 or 3.5. When a scratch somewhat occurs in both the sample and the reference minerals, the hardness of the sample is designated the same value as the reference mineral. The hardness designated by the Mohs scale of hardness represents the order of hardness but not an absolute value.

In the above-described particles, the diameter and shape are also important. The diameter of the particles is generally in the range of from 0.01 to 10 μm and preferably in the range of from 30 to 400% of the thickness of the back surface layer, although it varies depending upon the thickness of the back surface layer. With respect to the shape of the particles, a spherical shape rather than an acicular or columnar shape can impart a superior lubricity to the heat-resistant layer.

It is preferred for the above-described particles to be used in a proportion of 5 to 40 parts by weight based on 100 parts by weight of the above-described resin binder. When the amount of use of the particles are excessively small, the effect of imparting the lubricity is unsatisfactory. On the other hand, when it is excessively large, the flexibility or film strength of the formed back surface layer lowers.

Further, in the present invention, it is also possible to add, besides the above-described main components, additives known in the art, such as lubricants and antistatic agents, for example, lubricants, such as wax, silicone oil, higher fatty acid amides, esters and surfactants, and antistatic agents, such as quaternary ammonium salts and phosphoric esters in such an amount as will not spoil the object of the present invention.

When the phosphoric ester surfactant is used in combination with the alkaline substance and the particles having a Mohs hardness of less than 3, it is preferred for each of the phosphoric ester surfactant and alkaline substance to be used in an amount of 5 to 500 parts by weight based on 100 parts by weight of the above-described resin binder with the particles having a Mohs hardness of less than 3 being used in an amount of 5 to 40 parts by weight based on 100 parts by weight of the resin binder. When the amount of use of these materials is excessively small, the effect of imparting the lubricity and the neutralization effect are unsatisfactory. On the other hand, when the amount of use of these materials is excessively large, the flexibility and film strength of the back surface layer as a lubricating layer unfavorably lower.

The back surface layer in the thermal transfer sheet according to the present invention can be formed by dissolving or dispersing the above-described materials in a suitable solvent, such as acetone, methyl ethyl ketone or xylene, to prepare a coating solution, coating the coating solution on one surface of the substrate sheet by conventional coating means, such as a gravure coater, a roller coater or a wire bar and drying the coating and, if necessary, subjecting the dried coating to a crosslinking solution. The back surface layer is formed in a thickness of usually in the range of from 0.1 to 2 μm, preferably in the range of from 0.5 to 1 μm. It is noted that the formation of a primer layer comprising a polyurethane or polyester resin on the surface of the substrate sheet prior to the formation of the back surface layer is also useful in the present invention.

In the present invention, a primer layer may be provided between a substrate film 2 and a back surface layer 3. The primer layer contributes to an improvement in the adhesion of the back surface layer 3 to the substrate film 2. It may comprises, for example, an adhesive resin, such as a linear saturated polyester resin having a glass transition temperature of 50° C. or above or a mixture of such an adhesive resin with the above-described binder resin.

With respect to the colorant layer (recording agent layer) formed on the surface of the substrate sheet remote from the back surface layer, a layer containing a sublimation dye is formed in the case of a sublimation thermal transfer sheet, while a wax ink layer colored by a pigment is formed in the case of a hot-melt thermal transfer sheet.

The sublimation thermal transfer sheet will now be described as a representative example, though the present invention is not limited to the sublimation thermal transfer sheet alone.

There is no particular limitation on the dye used in the dye layer, and any dye used in the conventional thermal transfer sheets may be usefully used in the present invention. Several preferred examples of the dye will now be described. Examples of red dyes include MS Red G, Macrolex Red Violet R, Ceres Red 7B, Samaron Red HBSL and Resolin Red F3BS. Examples of yellow dyes include Phorone Brilliant Yellow 6GL and PTY-52 and Macrolex Yellow 6G. Examples of blue dyes include Kayaset Blue 714, Waxoline Blue Ap-FW, Phorone Brilliant Blue S-R and MS Blue 100. Preferred examples of binder resins for supporting the above-described dyes include cellulosic resins, such as ethyl cellulose, hydroxyethyl cellulose, ethylhydroxyl cellulose, hydroxypropyl cellulose, methyl cellulose, cellulose acetate, cellulose acetobutyrate, vinyl resins, such as polyvinyl alcohol, polyvinyl acetate, polyvinyl butyral, polyvinyl acetal and polyvinyl pyrrolidone, acrylic resins, such as poly(meth)acrylate and poly(meth)acrylamide, polyurethane resins, polyamide resins, and polyester resins. Among them, cellulosic, vinyl, acrylic, polyurethane, polyester and other resins are preferred from the viewpoint of heat resistance and migration of dye.

The dye layer can be formed by coating one surface of the above-described substrate sheet with a suitable organic solvent solution or water or organic solvent dispersion of the above-described dye and binder and optionally containing necessary additives, for example, a release agent, for example, by a gravure printing method, a screen printing method or a reverse roll coating method wherein use is made of a gravure print, and drying the resultant coating to form a dye-receiving layer.

The thickness of the dye layer thus formed is in the range of from 0.2 to 5.0 μm, preferably in the range of from 0.4 to 2.0 μm. It is preferred for the content of the sublimation dye in the dye layer to be in the range of from 5 to 90% by weight, preferably in the range of from 10 to 70% by weight, based on the weight of the dye layer.

When the desired image is a monocolor image, one color is selected from the above-described dyes for the formation of the dye layer. On the other hand, when the desired image is a full color image, suitable cyan, magenta and yellow (and further black according to need) dyes are selected for the formation of the dye layer.

The image receiving sheet used for the formation of an image using the above-described thermal transfer sheet may be any one so far as the recording face has a capability of receiving the above-described dyes. When use is made of materials not having a capability of receiving the dyes, such as paper, metals, glass, synthetic resins, a dye receiving layer may be formed on at least one surface of such materials. In the case of a hot-melt thermal transfer sheet, there is no particular limitation on the material, on which an image is to be transferred, and use may be made of conventional paper and plastic films.

There is no particular limitation on the printer for effecting a thermal transfer with the above-described thermal transfer sheet and image receiving sheet, and conventional thermal transfer printers, as such, may be used.

The present invention will now be described in more detail with reference to the following Examples. In the Examples, "parts" or "%" is by weight unless otherwise specified.

EXAMPLE A

At the outset, the following 9 compositions for a back surface layer were prepared.

| Composition No. 1 for back surface layer | |
|---|---|
| Polyvinyl butyral resin (solid content: 8%) (Eslec BX-1 manufactured by Sekisui Chemical Co., Ltd.) | 100 parts by weight |
| Lubricant (heat decomposition temp. = 365.6° C.) (Nonion OP-85R manufactured by Nippon Oils & Fats Co., Ltd.) | 1.6 parts by weight |
| **Composition No. 2 for back surface layer** | |
| Polyvinyl butyral resin (Eslec BX-1 manufactured by Sekisui Chemical Co., Ltd.) | 100 parts by weight |
| Lubricant (heat decomposition temp. = 300° C.) (Attrait AS1000 manufactured by Nippon | 1.6 parts by weight |

-continued

| | |
|---|---|
| Mining Co., Ltd.) | |
| Composition No. 3 for back surface layer | |
| Polyvinyl butyral resin (Eslec BX-1 manufactured by Sekisui Chemical Co., Ltd.) | 100 parts by weight |
| Lubricant (heat decomposition temp. = 401.7° C.) (Unister H381R manufactured by Nippon Oils & Fats Co., Ltd.) | 0.8 parts by weight |
| Lubricant (heat decomposition temp. = 190° C.) (Plysurf A208S manufactured by Dai-Ichi Kogyo Seiyaku Co., Ltd.) | 0.8 parts by weight |
| Composition No. 4 for back surface layer | |
| Polyvinyl butyral resin (Eslec BX-1 manufactured by Sekisui Chemical Co., Ltd.) | 100 parts by weight |
| Lubricant (heat decomposition temp. = 300° C.) (Attrait AS1000 manufactured by Nippon Mining Co., Ltd.) | 0.8 parts by weight |
| Lubricant (heat decomposition temp. = 190° C.) (Plysurf A208S manufactured by Dai-Ichi Kogyo Seiyaku Co., Ltd.) | 0.8 parts by weight |
| Composition No. 5 for back surface layer | |
| Polyvinyl butyral resin (solid content: 8%) (Eslec BX-1 manufactured by Sekisui Chemical Co., Ltd.) | 100 parts by weight |
| Lubricant (heat decomposition temp. = 397° C.) (Unister H481R manufactured by Nippon Oils & Fats Co., Ltd.) | 1.6 parts by weight |
| Talc | 0.5 parts by weight |
| Composition No. 6 for back surface layer | |
| Polyvinyl butyral resin (Eslec BX-1 manufactured by Sekisui Chemical Co., Ltd.) | 100 parts by weight |
| Polyisocyanate curing agent (Barnock D750 manufactured by Dainippon Ink and Chemicals, Inc.) | 40 parts by weight |
| Lubricant (heat decomposition temp. = 300° C.) (Attrait AS1000 manufactured by Nippon Mining Co., Ltd.) | 5 parts by weight |
| Talc | 1.5 parts by weight |
| Methyl ethyl ketone/toluene (mixing ratio = 1:1) | 16 parts by weight |
| Composition No. 7 for back surface layer | |
| Polyvinyl butyral resin (Eslec BX-1 manufactured by Sekisui Chemical Co., Ltd.) | 100 parts by weight |
| Polyisocyanate curing agent (Barnock D750 manufactured by Dainippon Ink and Chemicals, Inc.) | 40 parts by weight |
| Lubricant (heat decomposition temp. = 365.6° C.) (Nonion OP-85R manufactured by Nippon Oils & Fats Co., Ltd.) | 4 parts by weight |
| Lubricant (heat decomposition temp. = 190° C.) (Plysurf A208S manufactured by Dai-Ichi Kogyo Seiyaku Co., Ltd.) | 1 part by weight |
| Silica | 1.5 parts by weight |
| Methyl ethyl ketone/toluene (mixing ratio = 1:1) | 16 parts by weight |
| Composition No. 8 for back surface layer (for comparison) | |
| Polyvinyl butyral resin (Eslec BX-1 manufactured by Sekisui | 100 parts by weight |

-continued

| | |
|---|---|
| Chemical Co., Ltd.) | |
| Lubricant (heat decomposition temp. = 190° C.) (Plysurf A208S manufactured by Dai-Ichi Kogyo Seiyaku Co., Ltd.) | 1.6 parts by weight |
| Talc | 0.5 parts by weight |
| Composition No. 9 for back surface layer (for comparison) | |
| Polyvinyl butyral resin (Eslec BX-1 manufactured by Sekisui Chemical Co., Ltd.) | 100 parts by weight |
| Polyisocyanate curing agent (Barnock D750 manufactured by Dainippon Ink and Chemicals, Inc.) | 40 parts by weight |
| Lubricant (heat decomposition temp. = 190° C.) (Plysurf A208S manufactured by Dai-Ichi Kogyo Seiyaku Co., Ltd.) | 5 parts by weight |
| Talc | 1.5 parts by weight |
| Methyl ethyl ketone/toluene (mixing ratio = 1:1) | 16 parts by weight |

Further, the following compositions for a recording agent layer were prepared according to the following formulations.

| | |
|---|---|
| Composition No. 1 for recording agent layer | |
| Paraffin wax | 10 parts by weight |
| Carnauba wax | 10 parts by weight |
| Ethylene/vinyl acetate copolymer (Sumitate HC-10 manufactured by Sumitomo Chemical Co., Ltd.) | 1 part by weight |
| Carbon black (Seast 3 manufactured by Tokai Denkyoku Co., Ltd. | 2 parts by weight |
| Composition No. 2 for recording agent layer | |
| Disperse dye (Kayaset Blue 714 manufactured by Nippon Kayaku Co., Ltd. | 4 parts by weight |
| Polyvinyl butyral resin (Eslec BX-1 manufactured by Sekisui Chemical Co., Ltd.) | 4.3 parts by weight |
| Methyl ethyl ketone/toluene (mixing ratio = 1:1) | 80 parts by weight |
| Isobutanol | 10 parts by weight |

Then, the above-described compositions for a back surface layer and compositions for a recording agent layer were used to form a back surface layer on one surface of a 4.5 μm-thick polyethylene terephthalate film (Lumirror Manufactured by Toray Industries, Inc.) with a recording agent layer being formed on the other surface of the polyethylene terephthalate film to provide 18 thermal transfer sheets (samples 1 to 18) listed in Table 1.

In this case, the back surface layer was formed by coating the composition for a back surface layer by means of a wire bar coater (coverage: 1.0 g/m$^2$) and drying the coating with warm air. When the composition contained a curing agent, the coated film was allowed to stand in an atmosphere of 60° C. until the residual isocyanate does not remain any more to form a crosslinked coating.

The recording agent layer comprising a hot-melt ink was formed by coating the composition No. 1 for a recording agent layer in a hot-melt form at 130° C. by roll coating (coverage: 4.0 g/m$^2$). The recording layer containing a sublimation dye was formed by coating the composition No. 2 for a recording agent layer by means of a wire bar coater (coverage: 1.0 g/m$^2$) and drying the coating with warm air.

Then, printing was effected on individual thermal transfer sheets thus prepared under the following conditions to evaluate the state of abrasion of the surface protective film of the thermal head. The results of evaluation are given in Table 1.

| | |
|---|---|
| (Printing conditions for samples 1 to 9) | |
| Line period | 12 msec |
| Pulse width | 3 msec |
| Platen pressure | 4 kg |
| Printing travel distance | 30 km |
| (Printing conditions for samples 10 to 18) | |
| Line period | 16 msec |
| Pulse width | 8 msec |
| Platen pressure | 4 kg |
| Printing travel distance | 3 km |

TABLE 1

| Thermal transfer sheet | Composition for back surface layer | Composition for recording layer | State of abrasion of thermal head |
|---|---|---|---|
| Sample 1 | 1 | 1 | ○ |
| Sample 2 | 2 | 1 | ○ |
| Sample 3 | 3 | 1 | ○ |
| Sample 4 | 4 | 1 | ○ |
| Sample 5 | 5 | 1 | ○ |
| Sample 6 | 6 | 1 | ○ |
| Sample 7 | 7 | 1 | Δ |
| Sample 8 | 8 | 1 | x |
| Sample 9 | 9 | 1 | x |
| Sample 10 | 1 | 2 | ○ |
| Sample 11 | 2 | 2 | ○ |
| Sample 12 | 3 | 2 | ○ |
| Sample 13 | 4 | 2 | ○ |
| Sample 14 | 5 | 2 | ○ |
| Sample 15 | 6 | 2 | ○ |
| Sample 16 | 7 | 2 | Δ |
| Sample 17 | 8 | 2 | x |
| Sample 18 | 9 | 2 | x |

(Evaluation criteria)

In the observation of the :surface under an optical microscope,

○ . . . no abrasion observed,

Δ . . . abrasion somewhat observed, and

X . . . significant abrasion observed.

As is apparent from Table 1, when printing was effected by using thermal transfer sheets provided with a back surface layer containing a lubricant having a heat decomposition temperature of 200° C. or above (samples 1 to 7 and 10 to 16), substantially no adverse effect of the thermal transfer sheet on the thermal head was observed.

By contrast, when printing was effected by using thermal transfer sheets (samples 8, 9, 17 and 18) not containing a lubricant having a heat decomposition temperature of 200° C. or above, the abrasion of the thermal head was observed. These results clearly demonstrate the effect of the present invention.

As is apparent from the foregoing description, according to the present invention, since at least one lubricant having a heat decomposition temperature of 200° C. or above is contained in the back surface layer of the thermal transfer sheet, there is no possibility that the lubricant is heat-decomposed by heat applied by a thermal head when printing or formation of an image is effected by heating the thermal transfer sheet from its back surface layer side by means of a thermal head, so that the deterioration of the surface protective film of the thermal head is prevented, which enables the abrasion of the thermal head to be reduced.

EXAMPLE B1

| Composition for back surface layer: | |
|---|---|
| Polyvinyl butyral resin (Eslec BX-1 manufactured by Sekisui Chemical Co., Ltd.) | 2.2 parts |
| Polyisocyanate (Barnock D750 manufactured by Dainippon Ink and Chemicals, Inc.) | 6.8 parts |
| Phosphoric ester surfactant (Plysurf A208S manufactured by Dai-Ichi Kogyo Seiyaku Co., Ltd.) | 1.6 parts |
| Triethanolamine | 9.5 parts |
| Talc (Microace L-1 manufactured by Nippon Talc Co., Ltd.) | 0.4 part |
| Phosphoric ester sodium salt (Dispersant for talc; Phosphanol RD720 manufactured by Toho Chemical Industry Co., Ltd.) | 0.6 part |
| Toluene | 35.4 parts |
| Methyl ethyl ketone | 53.0 parts |

The above-described composition was coated on one surface of a PET substrate sheet (4.5 μm; manufactured by Diafoil Co., Ltd.) by means of a wire bar to a thickness of 1.0 μm on a dry basis, and the coating was dried with warm air and further heated in an oven at 60° C. for 2 days to effect a curing treatment, thereby forming a back surface layer.

The following composition for forming a dye layer was coated on the surface of the substrate sheet remote from the back surface layer by gravure printing to a thickness of 1.0 g/m$^2$ on a dry basis, and the coating was dried to provide a thermal transfer sheet of the present invention.

| Composition for forming dye layer: | |
|---|---|
| C.I. Solvent Blue 22 | 5.50 parts |
| Acetoacetal resin | 3.00 parts |
| Methyl ethyl ketone | 22.54 parts |
| Toluene | 68.18 parts |

EXAMPLES B2 to B4 COMPARATIVE EXAMPLES B1 and B2

The procedure of Example B1 was repeated to provide thermal transfer sheets of the present invention and comparative thermal transfer sheets (the thickness of the back surface layer in all the thermal transfer sheets being 1.0 μm), except that compositions listed in the following Table 2 was used instead of the composition for a back surface layer used in Example B1.

TABLE 2

| Components | Composition in Each Example (pt.wt.) | | | | |
|---|---|---|---|---|---|
| | Ex.B2 | Ex.B3 | Ex.B4 | Comp. Ex.B1 | Comp. Ex.B2 |
| Polyvinyl butyral resin (Eslec BX-1 manufactured by Sekisui Chemical Co., Ltd.) | 2.2 | 2.2 | 2.2 | 2.2 | 2.2 |
| Polyisocyanate (Barnock D750 manufactured by Dainippon Ink and Chemicals, Inc.) | 6.8 | 6.8 | 6.8 | 6.8 | 6.8 |
| Phosphoric ester surfactant (Plysurf A208S manufactured by Dai-Ichi Kogyo Seiyaku Co., Ltd.) | 1.6 | 1.6 | — | 1.6 | — |
| Phosphoric ester surfactant(Phosphanol RS710 manufactured by Toho Chemical Industry Co., Ltd.) | — | — | 1.6 | — | — |
| Triethanolamine | — | — | 9.5 | — | — |
| Diethanolamine | 8.0 | — | — | — | — |
| Magnesium hydroxide (Kisuma 5A manufactured by Kyowa Chemical Industry, Co., Ltd.) | — | 0.3 | — | — | — |
| Talc (Microace L-1 manufactured by Nippon Talc Co., Ltd.) | 0.4 | 0.4 | 0.4 | 0.4 | 0.4 |
| Phosphoric ester sodium salt (Phosphanol RD720 manufactured by Toho Chemical Industry Co., Ltd.) | 0.6 | 0.6 | 0.6 | 0.6 | 2.2 |
| Toluene | 35.4 | 35.4 | 35.4 | 35.4 | 35.4 |
| Methyl ethyl ketone | 53.0 | 53.0 | 53.0 | 53.0 | 53.0 |

The above-described thermal transfer sheet was put on a conventional thermal transfer image receiving sheet, and a transfer was effected by using a transfer recording device under the following conditions to examine the fusion between the thermal head and the thermal transfer sheet, the occurrence of a wrinkle and the migration of the dye (60°C., 17 g/m$^2$, 3 days). The results are given in the following Table 3.

| Transfer conditions: | |
|---|---|
| Pulse width | 1 msec |
| Recording period | 2.0 ms/line |
| Recording energy | 3.0 J/cm$^2$ |

TABLE 3

| Evaluation Item | Results of Evaluation | | | | | |
|---|---|---|---|---|---|---|
| | Ex. B1 | Ex. B2 | Ex. B3 | Ex. B4 | Comp. Ex.B1 | Comp. Ex.B2 |
| Occurrence of fusion and wrinkle | ○ | ○ | ○ | ○ | ○ | X |
| Migration of dye | ○ | ○ | ○ | ○ | ○ | Δ |
| Abrasion of protective film of thermal head | ○ | ○ | ○ | ○ | X | ○ |

| Evaluation Method: | |
|---|---|
| Occurrence of fusion and wrinkle | Observed with the naked eye:<br>○: Neither fusion nor wrinkle occurred<br>X: Fusion or wrinkle significantly occurred |
| Migration of dye | Observed with the naked eye:<br>○: No migration occurred<br>Δ: Migration somewhat occurred<br>X: Migration significantly occurred |
| Abrasion of protective film of thermal head | Solid printing was effected on 10000 sheets by using a commercially available video printer (VY-200 manufactured by Hitachi, Ltd.), and observation was made on dropout and unevenness on the printed face with the naked eye to judge the abrasion of the protective film of the thermal head:<br>○: Neither dropout nor lack of evenness on the printed face observed<br>X: Dropout or lack of evenness on the printed face observed |

As described above, according to the present invention, when a phosphoric ester surfactant and an alkaline substance are added to the back surface layer of the thermal transfer sheet, even though the phosphoric ester surfactant is decomposed by heat applied by the thermal head to produce an acid radical, since the acid radical is neutralized with the alkaline substance coexisting in the system, there occurs neither corrosion nor abrasion of the thermal head attributable to the occurrence of the acid radical. Further, according to a preferred embodiment, the adoption of a particular binder can provide a thermal transfer sheet having good heat resistance and back surface layer which is excellent in the travelling of the thermal head and gives rise to neither gathering of refuse on the thermal head nor abrasion of the thermal head.

EXAMPLE C1

| Composition for back surface layer: | |
|---|---|
| Polyvinyl butyral resin (Eslec BX-1 manufactured by Sekisui Chemical Co., Ltd.) | 22 parts |
| Polyisocyanate (Barnock D750 manufactured by Dainippon Ink and Chemicals, Inc.) | 65 parts |
| Lubricant (Nonion OP-85R manufactured by Nippon Oils & Fats Co., Ltd.) | 10 parts |
| Talc (Mohs hardness: 1, particle diameter: 4 μm, white powder) | 3 parts |
| Solvent (MEK/toluene = 1/1) | 1,000 parts |

The above-described composition was coated on one surface of a PET substrate sheet (6.0 μm; manufactured by Diafoil Co., Ltd.) by means of a wire bar to a thickness of 1.0 μm on a dry basis, and the coating was dried with warm air and further heated in an oven at 60° C. for 5 days to form a back surface layer.

Then, the following composition for forming a dye layer was coated on the surface of the substrate sheet remote from the back surface layer by gravure printing so that the thickness of the coating on a dry basis was 1.0 g/m$^2$, and the coating was dried to provide a thermal transfer sheet of the present invention.

| Composition for forming dye layer: | |
|---|---|
| C.I. Solvent Blue 22 | 5.50 parts |
| Acetoacetal resin | 3.00 parts |
| Methyl ethyl ketone | 22.54 parts |
| Toluene | 68.18 parts |

EXAMPLE C2

The procedure of Example C1 was repeated to provide a thermal transfer sheet of the present invention, except that a composition according to the following formulation was used instead of the composition used in Example C1.

| Composition for back surface layer: | |
|---|---|
| Polyvinyl butyral resin (Eslec BX-1 manufactured by Sekisui Chemical Co., Ltd.) | 22 parts |
| Polyisocyanate (Barnock D750 manufactured by Dainippon Ink and Chemicals, Inc.) | 65 parts |
| Lubricant (Nonion OP-85R manufactured by Nippon Oils & Fats Co., Ltd.) | 10 parts |

-continued

| Composition for back surface layer: | |
|---|---|
| Kaolin (Mohs hardness: 2, particle diameter: 4 μm, white powder) | 3 parts |
| Solvent (MEK/toluene = 1/1) | 1,000 parts |

EXAMPLE C3

The procedure of Example C1 was repeated to provide a thermal transfer sheet of the present invention, except that a composition according to the following formulation was used instead of the composition used in Example C1.

| Composition for back surface layer: | |
|---|---|
| Polyvinyl butyral resin (Eslec BX-1) | 22 parts |
| Polyisocyanate (Barnock D750 ) | 65 parts |
| Lubricant (Plysurf A2085) | 10 parts |
| Brucite (Mohs hardness: 2.5, particle diameter: 3 μm, white powder) | 3 parts |
| Solvent (MEK/toluene = 1/1) | 1,000 parts |

EXAMPLE C4

The procedure of Example C1 was repeated to provide a thermal transfer sheet of the present invention, except that a composition according to the following formulation was used instead of the composition for forming a dye layer used in Example C1.

| Wax composition: | |
|---|---|
| Carbon black | 15 parts |
| Ethylene/vinyl acetate copolymer | 8 parts |
| Paraffin wax | 50 parts |
| Carnauba wax | 25 parts |

The components were kneaded at 120° C. for 4 hr in an attritor to provide a composition which was then coated by hot-melt coating to form a composition layer.

COMPARATIVE EXAMPLE C1

The procedure of Example C1 was repeated to provide a comparative thermal transfer sheet, except that a composition according to the following formulation was used instead of the composition used in Example C1.

| Composition for back surface layer: | |
|---|---|
| Polyvinyl butyral resin (Eslec BX-1) | 22 parts |
| Polyisocyanate (Barnock D750) | 65 parts |
| Lubricant (Nonion OP-85R) | 10 parts |
| Calcite (Mohs hardness: 3, particle diameter: 4 μm, white powder) | 3 parts |
| Solvent (MEK/toluene = 1/1) | 1,000 parts |

The procedure of Example C1 was repeated to provide a comparative thermal transfer sheet, except that a composition according to the following formulation was used instead of the composition used in Example C1.

| Composition for back surface layer: | |
|---|---|
| Polyvinyl butyral resin (Eslec BX-1) | 22 parts |
| Polyisocyanate (Barnock D750) | 65 parts |
| Lubricant (Nonion OP-85R) | 10 parts |
| Quartz (Mohs hardness: 7, particle diameter: 4 μm, white powder) | 3 parts |
| Solvent (MEK/toluene = 1/1) | 1,000 parts |

The above-described thermal transfer sheet was put on a conventional thermal transfer image receiving sheet, a transfer was continuously effected by 1,000 m by means of a thermal transfer recording device under the following conditions, and the state of the thermal head, travelling of the thermal head and quality of the formed image were observed. The results are given in the following Table 4.

| Transfer conditions: | |
|---|---|
| Pulse width | 1 msec |
| Recording period | 2.0 ms/line |
| Recording energy | 3.0 J/cm$^2$ |

TABLE 4

| | Abrasion of Thermal Head | | | |
|---|---|---|---|---|
| | Printing portion | Non-printing portion | Travelling of thermal head | Image Quality |
| Ex. C1 | ○ | ○ | good (no wrinkle) | good |
| Ex. C2 | ○ | ○ | good (no wrinkle) | good |
| Ex. C3 | Δ | ○ | good (no wrinkle) | good |
| Ex. C4 | ○ | ○ | good (no wrinkle) | good |
| Comp. Ex. C1 | X | Δ | good (wrinkle somewhat occurred) | somewhat poor |
| Comp-Ex. C2 | X | X | poor (sound of travel of thermal head generated) | poor |

| Evaluation Method: | |
|---|---|
| Abrasion of thermal head: | Measured and evaluated visually and with a surface roughness tester: ○: No abrasion occurred Δ: Abrasion somewhat occurred X: Significant abrasion mark observed |
| Travelling of thermal head: | Observed with the naked eye. |
| Image quality: | Observed with the naked eye. |

As described above, according to the present invention, the presence of particles having a Mohs hardness of less than 3 in the back surface layer can provide a thermal transfer sheet which is excellent in both heat resistance and lubricity and satisfactory in the travelling of the thermal head, can provide a good image and gives rise to no abrasion of the thermal head.

EXAMPLE D

The procedure of Example B1 was repeated to provide thermal transfer sheets of respective Examples, except that the following compositions were used instead of the composition for a back surface layer used in Example B1.

EXAMPLE D1

| | |
|---|---|
| Polyvinyl butyral resin (Eslec BX-1 manufactured by Sekisui Chemical Co., Ltd.) | 40.0 parts |
| Phosphoric ester surfactant (Plysurf A208S manufactured by Dai-Ichi Kogyo Seiyaku Co., Ltd.) | 1.0 part |
| Talc (Microace P-3 manufactured by Nippon Talc Co., Ltd.) Mohs hardness: 1 | 0.4 part |
| Triethanolamine | 6.0 parts |

EXAMPLE D2

| | |
|---|---|
| Polyvinyl butyral resin (Eslec BX-1 manufactured by Sekisui Chemical Co., Ltd.) | 2.2 parts |
| Polyisocyanate (Barnock D750 manufactured by Dainippon Ink and Chemicals, Inc.) | 6.8 parts |
| Phosphoric ester surfactant (Plysurf A208S manufactured by Dai-Ichi Kogyo Seiyaku Co., Ltd.) | 1.6 parts |
| Talc (Microace P-3 manufactured by Nippon Talc Co., Ltd.) Mohs hardness: 1 | 0.4 part |
| Magnesium hydroxide (Kisuma 5A manufactured by Kyowa Chemical Industry, Co., Ltd.) | 0.3 part |

EXAMPLE D3

| | |
|---|---|
| Polyvinyl butyral resin (Eslec BX-1 manufactured by Sekisui Chemical Co., Ltd.) | 2.2 parts |
| Polyisocyanate (Barnock D750 manufactured by Dainippon Ink and Chemicals, Inc.) | 6.8 parts |
| Phosphoric ester surfactant (Nikkol DDP-2 (manufactured by Nikko Chemicals Co., Ltd.) | 1.6 parts |
| Talc (Microace P-3 manufactured by Nippon Talc Co., Ltd.) Mohs hardness: 1 | 0.4 part |
| Magnesium hydroxide (Kisuma 5A manufactured by Kyowa Chemical Industry, Co., Ltd.) | 0.3 part |

EXAMPLE D4

| | |
|---|---|
| Polyvinyl butyral resin (Eslec BX-1 manufactured by Sekisui Chemical Co., Ltd.) | 2.2 parts |

-continued

| | |
|---|---|
| Polyisocyanate (Barnock D750 manufactured by Dainippon Ink and Chemicals, Inc.) | 6.8 parts |
| Phosphoric ester surfactant (Plysurf A208S manufactured by Dai-Ichi Kogyo Seiyaku Co., Ltd.) | 1.6 parts |
| Kaolin (Attagel 50 manufactured by Tsuchiya Kaolin Co., Ltd.) Mohs hardness: 0.4 | 0.4 part |
| Magnesium hydroxide (Kisuma 5A manufactured by Kyowa Chemical Industry, Co., Ltd.) | 0.3 part |

EXAMPLE D5

| | |
|---|---|
| Polyvinyl butyral resin (Eslec BX-1 manufactured by Sekisui Chemical Co., Ltd.) | 2.2 parts |
| Polyisocyanate (Barnock D750 manufactured by Dainippon Ink and Chemicals, Inc.) | 6.8 parts |
| Phosphoric ester surfactant (Plysurf A208S manufactured by Dai-Ichi Kogyo Seiyaku Co., Ltd.) | 1.6 parts |
| Clay (ASP-200 manufactured by Tsuchiya Kaolin Co., Ltd.) Mohs hardness: 2 | 0.4 part |
| Magnesium hydroxide (Kisuma 5A manufactured by Kyowa Chemical Industry, Co., Ltd.) | 0.3 part |

EXAMPLE D6

| | |
|---|---|
| Polyvinyl butyral resin (Eslec BX-1 manufactured by Sekisui Chemical Co., Ltd.) | 2.2 parts |
| Polyisocyanate (Barnock D750 manufactured by Dainippon Ink and Chemicals, Inc.) | 6.8 parts |
| Phosphoric ester surfactant (Plysurf A208S manufactured by Dai-Ichi Kogyo Seiyaku Co., Ltd.) | 1.6 parts |
| Kaolin (Attagel 50 manufactured by Tsuchiya Kaolin Co., Ltd.) Mohs hardness: 1 | 0.4 part |
| Hydrotalcite (DHT-4A manufactured by Kyowa Chemical Industry, Co., Ltd.) | 0.3 part |

Reference Example D1

| | |
|---|---|
| Polyvinyl butyral resin (Eslec BX-1 manufactured by Sekisui Chemical Co., Ltd.) | 40.0 parts |
| Phosphoric ester surfactant (Plysurf A208S manufactured by Dai-Ichi Kogyo Seiyaku Co., Ltd.) | 1.0 parts |
| Talc (Microace P-3 manufactured by Nippon Talc Co., Ltd.) Mohs hardness: 1 | 0.4 part |

Reference Example D2

| | |
|---|---|
| Polyvinyl butyral resin (Eslec BX-1 manufactured by Sekisui Chemical Co., Ltd.) | 2.2 parts |
| Polyisocyanate (Barnock D750 manufactured by Dainippon Ink and Chemicals, Inc.) | 6.8 parts |
| Phosphoric ester surfactant (Plysurf A208S manufactured by Dai-Ichi Kogyo Seiyaku Co., Ltd.) | 1.6 parts |
| Kaolin (Attagel 50 manufactured by Tsuchiya Kaolin Co., Ltd.) Mohs hardness: 1 | 0.4 part |

COMPARATIVE EXAMPLE D1

| | |
|---|---|
| Polyvinyl butyral resin (Eslec BX-1 manufactured by Sekisui Chemical Co., Ltd.) | 2.2 parts |
| Polyisocyanate (Barnock D750 manufactured by Dainippon Ink and Chemicals, Inc.) | 6.8 parts |
| Phosphoric ester surfactant (Plysurf A208S manufactured by Dai-Ichi Kogyo Seiyaku Co., Ltd.) | 1.6 parts |
| Silica (Nipsil HD manufactured by Nippon Silica Industrial Co., Ltd.) Mohs hardness: 7 | 0.4 part |

COMPARATIVE EXAMPLE D2

| | |
|---|---|
| Polyvinyl butyral resin (Eslec BX-1 manufactured by Sekisui Chemical Co., Ltd.) | 2.2 parts |
| Polyisocyanate (Barnock D750 manufactured by Dainippon Ink and Chemicals, Inc.) | 6.8 parts |
| Phosphoric ester surfactant (Plysurf A208S manufactured by Dai-Ichi Kogyo Seiyaku Co., Ltd.) | 1.6 parts |
| $SnO_2$ (SN-100P manufactured by Ishihara Sangyo Kaisha Co., Ltd.) Mohs hardness: 6.5 | 0.4 part |

Results of Evaluation

TABLE 5

| Ex. No. | Isocyanate | Neutralizer | Filler (Mohs hardness) | Fusion and wrinkle | Dye migration | Abrasion of thermal head |
|---|---|---|---|---|---|---|
| D1 | free | triethanolamine | talc (1) | ○ | Δ | ○ |
| D2 | added | $Mg(OH)_2$ | talc (1) | ○ | ○ | ○ |
| D3 | added | $Mg(OH)_2$ | talc (1) | ○ | ○ | ○ |
| D4 | added | $Mg(OH)_2$ | kaolin (1) | ○ | ○ | ○ |
| D5 | added | $Mg(OH)_2$ | clay (2) | ○ | ○ | ○ |
| D6 | added | hydro- | kaolin | ○ | ○ | ○ |

TABLE 5-continued

| | Isocyanate | Neutralizer | Filler (Mohs hardness) | Fusion and wrinkle | Dye migration | Abrasion of thermal head |
|---|---|---|---|---|---|---|
| | | talcite | (1) | | | |
| Reference Ex. No. | | | | | | |
| D1 | free. | free | talc (1) | Δ | Δ | Δ |
| D2 | added | free | kaolin (1) | ○ | ○ | Δ |
| Comp. Ex. No. | | | | | | |
| D1 | added | free | silica (7) | ○ | ○ | x |
| D2 | added | free | $SnO_2$ (6.5) | ○ | ○ | x |

Evaluation Method:

| | |
|---|---|
| Occurrence of fusion and wrinkle | Observed with the naked eye: ○: Neither fusion nor wrinkle occurred Δ: fusion nor wrinkle somewhat occurred. X: Fusion nor wrinkle significantly occurred |
| Migration of dye | Observed with the naked eye: ○: No migration occurred Δ: Migration somewhat occurred X: Migration significantly occurred |
| Abrasion of protective film of thermal head | Solid printing was effected on 10000 sheets by using a commercially available video printer (VY-200 manufactured by Hitachi, Ltd.), and observation was made on dropout and unevenness on the printed face with the naked eye to judge the abrasion of the protective film of the thermal head: ○: Neither dropout nor lack of evenness on the printed face observed Δ: Dropout or lack of evenness somewhat observed X: Dropout or lack of evenness on the printed face observed |

EXAMPLE E

The procedure of Example B1 was repeated to provide thermal transfer sheets of respective Examples, except that the following composition was used instead of the composition for a back surface layer used in Example B1.

EXAMPLE E1

| | |
|---|---|
| Polyvinyl butyral resin (Eslec BX-1 manufactured by Sekisui Chemical Co., Ltd.) | 40.0 parts |
| Lubricant (Nonion OP-85R manufactured by Nippon Oils & Fats Co., Ltd.) Heat decomposition temp.: 365.6° C. | 1.0 part |
| Talc (Microace P-3 manufactured by Nippon Talc Co., Ltd.) Mohs hardness: 1 | 0.4 part |

-continued

EXAMPLE E2

| | |
|---|---|
| Polyvinyl butyral resin (Eslec BX-1 manufactured by Sekisui Chemical Co., Ltd.) | 2.2 parts |
| Polyisocyanate (Barnock D750 manufactured by Dainippon Ink and Chemicals, Inc.) | 6.8 parts |
| Lubricant (Nonion OP-85R manufactured by Nippon Oils & Fats Co., Ltd.) Heat decomposition temp.: 365.6° C. | 1.6 part |
| Talc (Microace P-3 manufactured by Nippon Talc Co., Ltd.) Mohs hardness: 1 | 0.4 part |

EXAMPLE E3

| | |
|---|---|
| Polyvinyl butyral resin (Eslec BX-1 manufactured by Sekisui Chemical Co., Ltd.) | 2.2 parts |
| Polyisocyanate (Barnock D750 manufactured by Dainippon Ink and Chemicals, Inc.) | 6.8 parts |
| Lubricant (Attrait AS100 manufactured by Nippon Mining Co., Ltd.) Heat decomposition temp.: 300° C. | 1.6 part |
| Talc (Microace P-3 manufactured by Nippon Talc Co., Ltd.) Mohs hardness: 1 | 0.4 part |

EXAMPLE E4

| | |
|---|---|
| Polyvinyl butyral resin (Eslec BX-1 manufactured by Sekisui Chemical Co., Ltd.) | 2.2 parts |
| Polyisocyanate (Barnock D750 manufactured by Dainippon Ink and Chemicals, Inc.) | 6.8 parts |
| Lubricant (Plysurf A208S manufactured by Dai-Ichi Kogyo Seiyaku Co., Ltd.) Heat decomposition temp.: 190° C. | 0.8 parts |
| Lubricant (Unister H381R manufactured by Nippon Oils & Fats Co., Ltd.) Heat decomposition temp.: 401.7° C. | 0.8 part |
| Kaolin (Attagel 50 manufactured by Tsuchiya Kaolin Co., Ltd.) Mohs hardness: 1 | 0.4 part |

EXAMPLE E5

| | |
|---|---|
| Polyvinyl butyral resin (Eslec BX-1 manufactured by Sekisui Chemical Co., Ltd.) | 2.2 parts |
| Polyisocyanate (Barnock D750 manufactured by Dainippon Ink and Chemicals, Inc.) | 6.8 parts |
| Lubricant (Unister H481R manufactured by Nippon Oils & Fats Co., Ltd.) Heat decomposition temp.: 397° C. | 1.6 parts |
| Clay (ASP-200 manufactured by Tsuchiya Kaolin Co., Ltd.) Mohs hardness: 2 | 0.4 part |

REFERENCE EXAMPLE E1

| | |
|---|---|
| Polyvinyl butyral resin (Eslec BX-1 manufactured by Sekisui Chemical Co., Ltd.) | 40.0 parts |
| Lubricant (Plysurf A208S manufactured by Dai-Ichi Kogyo Seiyaku Co., Ltd.) Heat decomposition temp.: 190° C. | 1.0 part |
| Talc (Microace P-3 manufactured by Nippon Talc Co., Ltd.) Mohs hardness: 1 | 0.4 part |

REFERENCE EXAMPLE E2

| | |
|---|---|
| Polyvinyl butyral resin (Eslec BX-1 manufactured by Sekisui Chemical Co., Ltd.) | 2.2 parts |
| Polyisocyanate (Barnock D750 manufactured by Dainippon Ink and Chemicals, Inc.) | 6.8 parts |
| Lubricant (Plysurf A208S manufactured by Dai-Ichi Kogyo Seiyaku Co., Ltd.) Heat decomposition temp.: 190° C. | 1.6 parts |
| Kaolin (Attagel 50 manufactured by Tsuchiya Kaolin Co., Ltd.) Mohs hardness: 1 | 0.4 part |

COMPARATIVE EXAMPLE E1

| | |
|---|---|
| Polyvinyl butyral resin (Eslec BX-1 manufactured by Sekisui Chemical Co., Ltd.) | 2.2 parts |
| Polyisocyanate (Barnock D750 manufactured by Dainippon Ink and Chemicals, Inc.) | 6.8 parts |
| Lubricant (Nikkol DDP-2 (manufactured by Nikko Chemicals Co., Ltd.) Heat decomposition temp.: 190° C. | 1.6 parts |
| Silica (Nipsil HD manufactured by Nippon Silica Industrial Co., Ltd.) Mohs hardness: 7 | 0.4 part |

COMPARATIVE EXAMPLE E2

| | |
|---|---|
| Polyvinyl butyral resin (Eslec BX-1 manufactured by Sekisui Chemical Co., Ltd.) | 2.2 parts |
| Polyisocyanate (Barnock D750 manufactured by Dainippon Ink and Chemicals, Inc.) | 6.8 parts |
| Lubricant (Nikkol DDP-2 (manufactured by Nikko Chemicals Co., Ltd.) Heat decomposition temp.: 190° C. | 1.6 parts |
| $SnO_2$ (SN-100P manufactured by Ishihara Sangyo Kaisha Co., Ltd.) Mohs hardness: 6.5 | 0.4 part |

TABLE 6

| | Isocyanate | Heat decomposition temp. (°C.) | Filler (Mohs hardness) | Fusion and wrinkle | Dye migration | Abrasion of thermal head |
|---|---|---|---|---|---|---|
| Ex. No. | | | | | | |
| E1 | free | 365.6 | talc (1) | Δ | Δ | ○ |
| E2 | added | 365.6 | talc (1) | ○ | ○ | ○ |
| E3 | added | 300 | talc (1) | ○ | ○ | ○ |
| E4 | added | 190 | kaolin (1) | ○ | ○ | ○ |
| E5 | added | 397 | clay (2) | ○ | ○ | ○ |
| Reference Ex. No. | | | | | | |
| E1 | free. | 190 | talc (1) | Δ | Δ | Δ |
| E2 | added | 190 | kaolin (1) | ○ | ○ | Δ |
| Comp. Ex. No. | | | | | | |
| E1 | added | 190 | silica (7) | ○ | ○ | x |
| E2 | added | 190 | $SnO_2$ (6.5) | ○ | ○ | x |

Evaluation methods and evaluation items are the same as those described above in connection with Table 5.

We claim:

1. A thermal transfer sheet comprising:

a substrate film;

a recording agent layer formed on one surface of said substrate film; and a back surface layer formed on the other surface of said substrate film, said back surface layer comprising (i) at least one lubricant having a heat decomposition temperature of 200° C. or above, said at least one lubricant comprising an alkali metal salt, and (ii) particles having a Mobs hardness of less than 3.

2. A sublimation transfer system including the thermal transfer sheet of claim 1.

3. The wax transfer system including the thermal transfer sheet of claim 1.

4. A thermal transfer sheet comprising:

a substrate sheet;

a thermally transferable colorant layer formed on one surface of said substrate sheet; and a back surface layer formed on the other surface of said substrate sheet, said back surface layer comprising a phosphoric ester surfactant, an alkaline substance and a binder.

5. A thermal transfer sheet according to claim 1, wherein said back surface layer further comprises a binder comprising a hydroxyl-group-containing thermoplastic resin and a polyisocyanate.

6. A thermal transfer sheet according to claim 5, wherein said thermoplastic resin is a polyvinyl acetal resin or a mixture thereof.

7. A thermal transfer sheet according to claim 4, wherein said alkaline substance is at least one member selected from the group consisting of an oxide and a hydroxide of an alkali metal and an alkaline earth metal and an organic amine.

8. A thermal transfer sheet according to claim 7, wherein the molar ratio of said phosphoric ester surfactant to said alkaline substance is in the range of from 1:0.1 to 1:10.

9. A thermal transfer sheet according to claim 4, wherein said phosphoric ester surfactant is a nonionic or an anionic surfactant.

10. A thermal transfer sheet according to claim 4, wherein said back surface layer further comprises particles having a Mohs hardness of less than 3.

11. A thermal transfer sheet according to claim 4, wherein the binder in said back surface layer comprises a hydroxyl-group-containing thermoplastic resin and a polyisocyanate.

12. A thermal transfer sheet according to claim 11, wherein said thermoplastic resin is a polyvinyl acetal resin or a mixture thereof.

13. A sublimation transfer system including the thermal transfer sheet of claim 4.

14. A wax transfer system including the thermal transfer sheet of claim 4.

* * * * *